US007299866B2

(12) United States Patent
Jacklin

(10) Patent No.: US 7,299,866 B2
(45) Date of Patent: Nov. 27, 2007

(54) APPARATUS AND METHOD FOR CLEANING OUT SAND FROM AN UNDERBALANCED HYDROCARBON PRODUCING WELL

(76) Inventor: Shawn Arthur Jacklin, 33-10001-101 Avenue, Grande Prairie, Alberta (CA) T8V 0X9

( * ) Notice: Subject to any disclaimer, the term of this patent is extended or adjusted under 35 U.S.C. 154(b) by 126 days.

(21) Appl. No.: 11/167,355

(22) Filed: Jun. 27, 2005

(65) Prior Publication Data

US 2006/0131023 A1 Jun. 22, 2006

(30) Foreign Application Priority Data

Dec. 16, 2004 (CA) ..... 2490346

(51) Int. Cl.
*E21B 34/02* (2006.01)

(52) U.S. Cl. ..... 166/95.1; 166/319; 175/214; 175/218; 285/190

(58) Field of Classification Search ..... 166/95.1, 166/319; 175/214, 218; 285/190
See application file for complete search history.

(56) References Cited

U.S. PATENT DOCUMENTS 2,163,115 A * 6/1939 Beckman ..... 175/205
3,750,749 A 8/1973 Giroux
3,805,894 A 4/1974 Giroux
4,425,965 A 1/1984 Bayh, III
4,655,302 A 4/1987 McCreadie et al.
4,749,341 A 6/1988 Bayh, III

OTHER PUBLICATIONS

Tubing Swivel Product Information Publication, BJ Services Company, Nov. 1, 2002.

* cited by examiner

*Primary Examiner*—David Bagnell
*Assistant Examiner*—Giovanna M Collins

(57) ABSTRACT

An apparatus and method is used in the cleaning out of sand in underbalanced gas wells. The present invention includes a valve subassembly equipped with an emergency shutin device to remotely control the actuation of the valve via an air or hydraulic control line. Operatively coupled to the inlet of the valve subassembly is a swivel subassembly which further enables the coupling to a tubing string. A lifting assembly attaches the valve subassembly to an elevator of a well service rig. A hardened elbow coupled to an outlet of the valve subassembly directs the gas/sand mixture being removed from the well through a hose to a collection pit. The use of the apparatus of the present invention in a sand cleanout operation allows joints of pipe to be tripped into and out of the tubing string all the while keeping the emergency shutdown device actuator connected and operational.

18 Claims, 7 Drawing Sheets

APPARATUS AND METHOD FOR CLEANING OUT SAND FROM AN UNDERBALANCED HYDROCARBON PRODUCING WELL

FIELD OF THE INVENTION

The present invention relates to the field of tubing valves used in the removal of sand from underbalanced hydrocarbon producing wells.

BACKGROUND OF THE INVENTION

In hydrocarbon producing wells, in particular, natural gas wells, multiple gas producing formations in the vertical strata of the gas field may be present. A well may pass from multiple formations along its vertical height. When drilling a well that contains multiple formations, it is common practice to place a plug in the well to separate vertically adjacent formations. To protect the plug itself, it is known to place a sufficient amount of sand on top of the plug. A well having sand placed in this manner is referred to an "underbalanced well". In a well D with multiple formations A, as shown in FIG. 1, plug B is placed in well D to separate each formation A. Sand C is then placed on top of each plug B.

When the uppermost formation has almost been depleted, the plug and the sand separating the uppermost formation and the formation beneath it needs to be removed. To remove the sand, it is known to lower a string of tubing into the well until the lower end of the tubing is near the sand. Coupled on top of the tubing is a valve subassembly, such as a ball valve subassembly commonly known to those skilled in the art. A safety valve subassembly is often used on top of the first valve subassembly. The safety valve subassembly typically incorporates a valve actuator known as an emergency shut-in device or "ESD". Due to the explosive nature of natural gas, the ESD is operated by a compressed air or hydraulic line as opposed to an electrically-controlled actuator. The ESD is controlled by a remotely located switch situated near the floor of the well service rig so that it is easily accessible by an operator.

When a joint of tubing is lowered into a well, the first valve subassembly is closed. The tubing may be rotated about its longitudinal axis so that it may descend into the well easily. This requires that the control line to the ESD of the safety valve subassembly to be disconnected as the safety valve subassembly will also rotate as the tubing is lowered into the well. Once the tubing is positioned to remove the sand in the well, the control line is reconnected to the ESD and the first valve subassembly is opened thereby allowing the pressure of the formation to force gas up the tubing drawing along sand with it. In the event of an emergency, the ESD can be activated by an operator to close the safety valve subassembly and stop the sand cleanout operation.

If additional joints of tubing are required to be tripped into the tubing string, the first valve subassembly is closed and the control line to the ESD is disconnected. The connection between the first valve subassembly and safety valve subassembly is broken and another joint of tubing is inserted between the first valve subassembly and the safety valve subassembly. The second valve subassembly is also placed between the second joint of pipe and the safety valve subassembly. The second valve subassembly is initially placed in the closed position. The first valve subassembly is then opened and the string of tubing is then lowered further into the well. When the string is in position, the control line is reattached to the ESD and the second valve subassembly is then opened to continue with the sand cleanout operation. If multiple joints of tubing are required, this procedure is repeated for each joint of tubing placed in the tubing string.

As the safety valve subassembly with the ESD is part of the tubing string, the control line must be repeatedly disconnected and reconnected for each joint of tubing added to the tubing string. This procedure adds considerable time and inconvenience to the operation. To avoid this inconvenience, some well service operators may choose not to use a safety valve subassembly with an ESD at all. This causes a potentially hazardous situation for operators as there is no standby emergency shutdown mechanism to shut down the operation in the event of an emergency.

Therefore, it is desirable to have a safety valve subassembly with an ESD that does not have to have its control line disconnected and reconnected every time a joint of tubing is tripped into or out of the tubing string.

SUMMARY OF THE INVENTION

The present invention is an apparatus and method for use in cleaning out sand from an underbalanced well that allows the ESD of a safety valve subassembly to remain connected to its control line when joints of tubing are tripped into the tubing string.

The apparatus of the present invention is a valve subassembly, as well known to those skilled in the art, having a tubing swivel subassembly rotatably coupled to the lower or inlet end of the valve subassembly. The valve subassembly has a valve mechanism, such as a ball valve, adapted to be operated by a valve actuator or ESD. The ESD is connected to a control line operated by a remotely located switch near the platform of the well service rig.

In an illustrative embodiment of the present invention, one end of a hardened elbow, such as a Chicksan™ elbow, is coupled to the upper or outlet end of the valve subassembly. A high pressure hose is coupled to the other end of the elbow to direct sand to a pit. The use of a hardened elbow is beneficial as the material wear properties of the elbow absorb the brunt of the abrasive effects of sand being blown out of the well by the formation pressure and through the valve subassembly. This embodiment is suitable for wells having formation pressures greater than 2500 psi.

In this illustrative embodiment, the valve subassembly is supported by a valve cradle in which the valve subassembly is fastened to. The valve cradle also provides the interconnection between the valve subassembly and the swivel subassembly. A fork assembly attached to the elevator of the service rig supports the valve cradle by having the ends of the fork legs pivotally attached to said valve cradle. A singular rod projecting upwards from the upper end of the fork provides the means to attach to the apparatus to the elevator of a well service rig.

In an alternate embodiment, the valve subassembly has an exit port extending through the sidewall of the valve, the port located above the valve mechanism. The exit port has a hardened elbow, such as a Chicksan™ elbow, attached to it. A high pressure hose is connected to the other end of the elbow directs the sand to a pit. In place of a fork assembly, this alternate embodiment uses a pickup subassembly threaded into the upper or outlet end of the valve subassembly. The pickup subassembly, in turn, couples the valve subassembly to the elevator of the service rig. A sand plug is fitted within the valve subassembly between the exit port and the pickup subassembly. The sand plug is placed within the valve subassembly to absorb the brunt of the abrasive effects of the sand flowing through the valve subassembly and out the exit port. Due to the sharp bend the flow of sand makes as it passes through the valve subassembly and the exit port, the sand can wear or abrade the internals of the valve subassembly. Accordingly, this embodiment is more suitable for wells having formation pressures less than 2500 psi.

The method of the present invention comprises attaching the apparatus of the present invention to the elevator of a well service rig. The ESD control line is attached to the valve actuator on the valve subassembly and remains connected all throughout the sand cleanout operations. A hardened elbow and hose are attached to the valve subassembly to direct the sand removed from the well to a pit. A second valve subassembly is coupled to coupling means disposed on the lower end of the swivel subassembly of the apparatus followed by a joint of tubing being coupled to the second valve subassembly. Initially, the second valve subassembly is closed. As the joint of tubing is lowered into the well, the tubing may be rotated during its descent into the well. The swivel subassembly allows the tubing string to rotate while the valve subassembly remains stationary. Once the tubing has been lowered into position, the second valve subassembly is opened allowing the gas to rise up through the tubing and drawing the sand with it. The gas/sand mixture rises up the tubing, through the open second valve subassembly, through the apparatus of the present invention, and out through the hardened elbow and hose into the pit. The sand lands into the pit whereas the gas is simply released into the atmosphere.

When another joint of tubing is needed to be tripped into the tubing string, the second valve is closed and a joint of tubing along with a third valve subassembly (also in a closed position) is tripped into the tubing string between the swivel subassembly and the second valve subassembly. The second valve subassembly is opened and the tubing string is then further lowered into the well. Once the tubing string has been lowered into position, the third valve subassembly is opened allowing gas to clear out the sand in the procedure described above.

All the while, the control lines of the ESD of the valve subassembly remains connected. It does not have to be disconnected and reconnected every time a joint of tubing is tripped into the tubing string. This saves time and speeds the sand cleanout operation. In the event of an emergency, the cleanout operation can be stopped by operating the remove switch for the ESD thereby closing the valve subassembly.

Broadly stated, one aspect of the present invention is an apparatus for cleaning out sand from an underbalanced hydrocarbon producing well, comprising: a valve subassembly having a valve body comprising: an upper end having coupling means, a lower end adapted to couple to a swivel subassembly, a passageway disposed within said valve body providing communication between said upper and lower ends, and a valve mechanism disposed in said passageway for opening and closing said passageway; a swivel subassembly operatively coupled to said lower end of said valve body.

Broadly stated, another aspect of the present invention is a method for cleaning out sand from an underbalanced hydrocarbon producing well, the method comprising the steps of: attaching an apparatus consisting of: a valve subassembly having a valve body comprising: an upper end having coupling means, a lower end adapted to couple to a swivel subassembly, a passageway disposed within said valve body providing communication between said upper and lower ends, and a valve mechanism disposed in said passageway for opening and closing said passageway, a swivel subassembly operatively coupled to said lower end of said valve body, and lift support means operatively coupled to said valve subassembly for attaching with an elevator of a well service rig to an elevator of a well service rig, the valve mechanism of said apparatus in an open position; attaching a first joint of tubing to a lower end of second valve subassembly; attaching an upper end of said second valve subassembly to the swivel assembly of said apparatus, said second valve subassembly in a closed position; lowering said first joint of tubing into said well; and opening said second valve subassembly whereby the pressure of a hydrocarbon formation in said well forces said sand up said tubing and exiting through said apparatus.

DETAILED DESCRIPTION OF EMBODIMENTS

Figure 1:
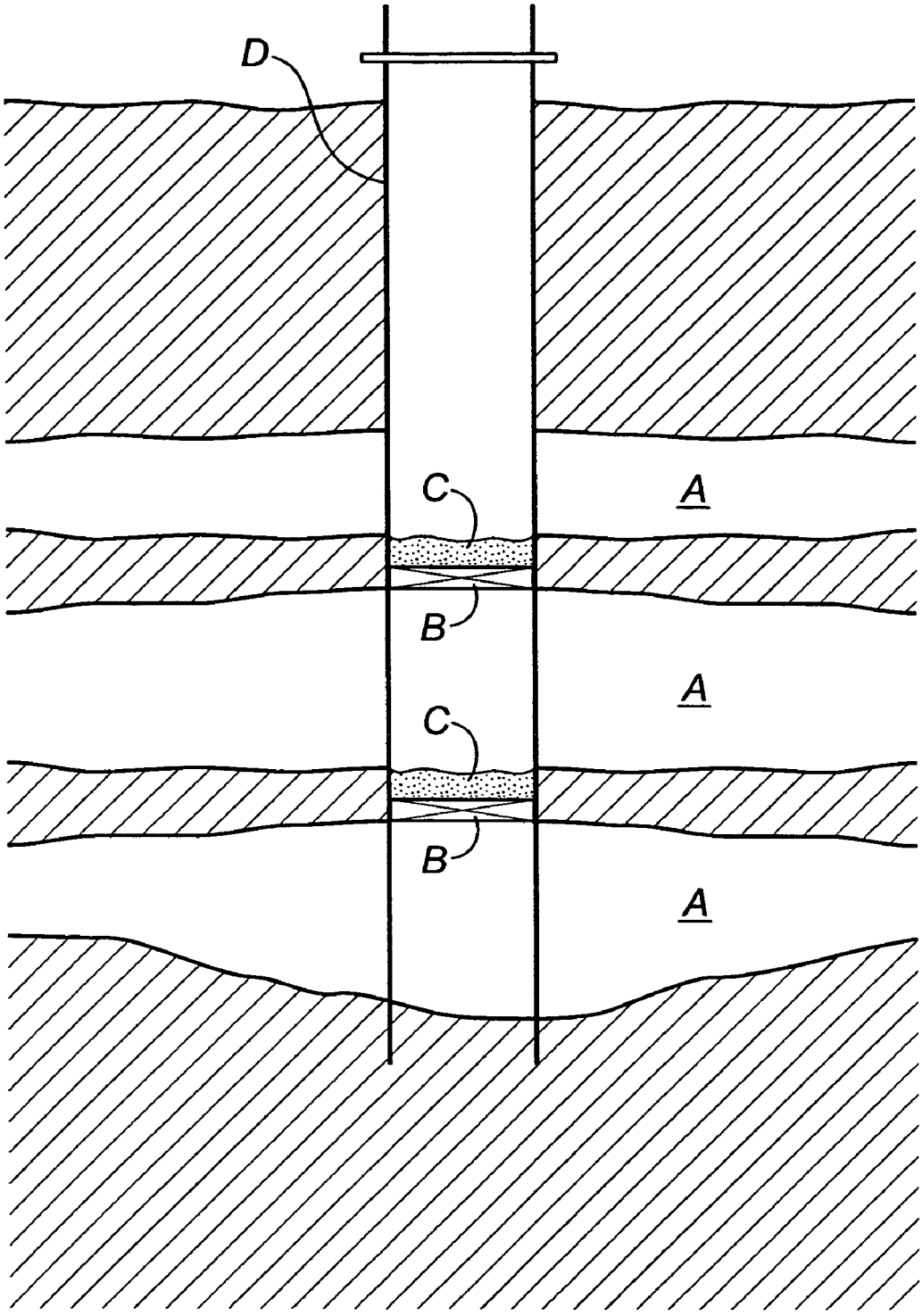
FIG. 1 (Prior Art)
FIG. 1 is a front cross-sectional view of a well formation during sand cleanout operations of an underbalanced hydrocarbon producing well.
Figure 2:
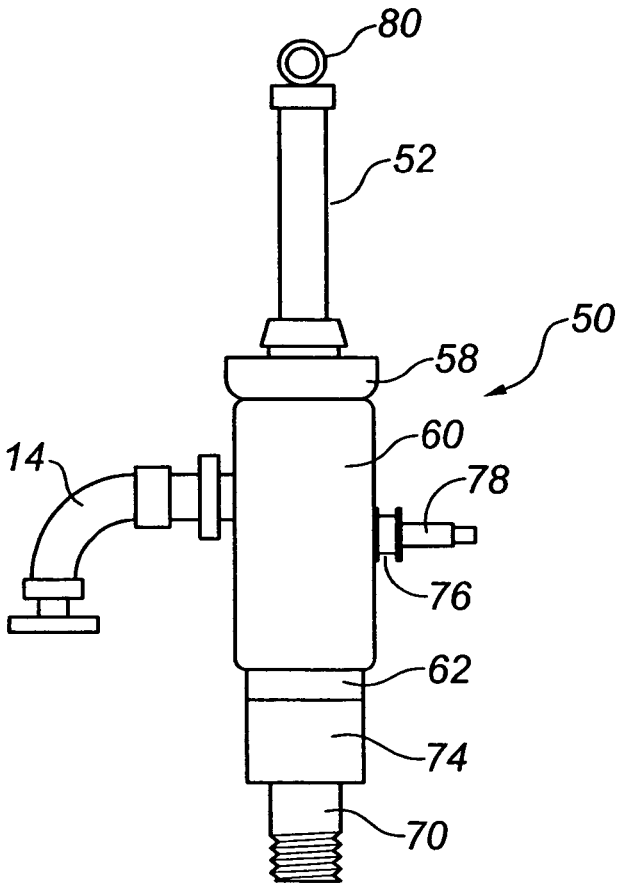
FIG. 2 is a front elevational view of a first embodiment of the apparatus of the present invention.
Figure 3:
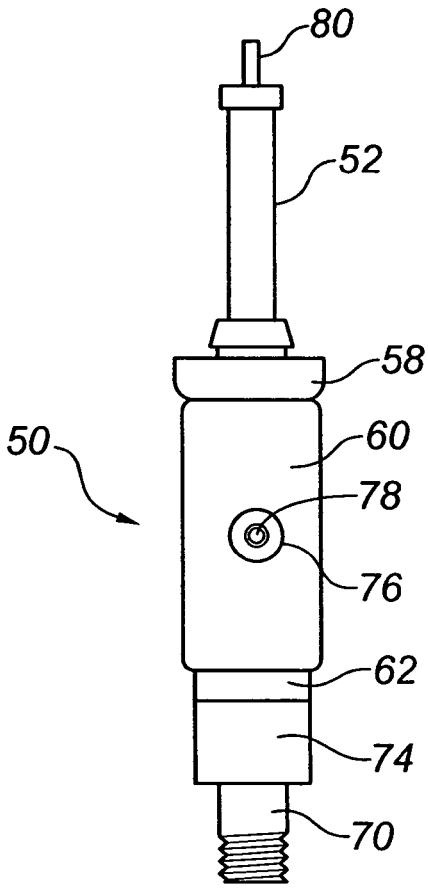
FIG. 3 is a side elevational view of the first embodiment of the apparatus of the present invention.
Figure 4:
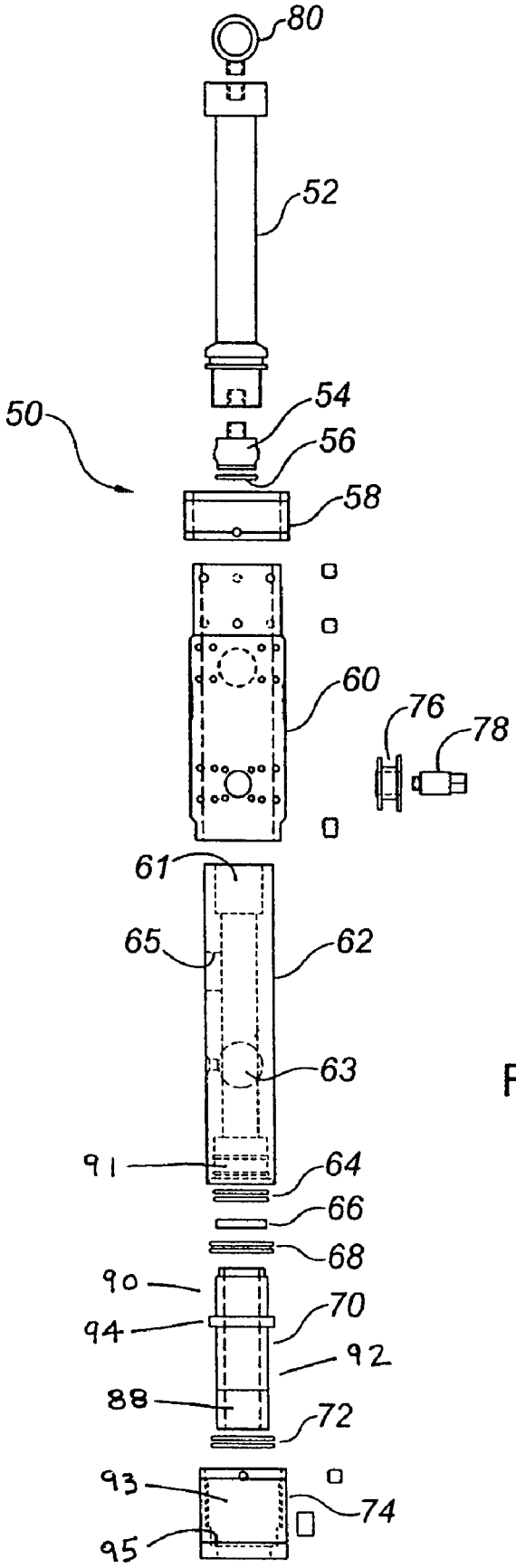
FIG. 4 is an exploded front view of the first embodiment of the apparatus of the present invention.

Referring to FIGS. 2, 3 and 4, a first embodiment of the present invention shown. Apparatus 50 comprises a valve subassembly 62 having ball valve 63. Valve subassembly 62 can be provided as a 5000 psi, 27/8" slimline ball valve subassembly which is readily and commercially available and as well known to those skilled in the art. Swivel subassembly 70 is rotatably coupled to valve subassembly 62 with swivel cap 74. Disposed between valve subassembly 62 and swivel subassembly 70 are o-rings 64, teflon ring 66 and thrust bearing 68. Disposed between swivel subassembly 70 and swivel cap 74 are thrust bearings 72. As shown in FIG. 4, swivel subassembly 70 can be a cylindrical or tubular member having upper end 90, lower end 92 and retaining ring 94 disposed therebetween. Upper end 90 passes through thrust bearing 68, teflon ring 66 and o-rings 64 into opening 91 disposed at the lower end of valve subassembly 62 that is adapted to receive swivel subassembly 70. Upper end 90 is inserted into opening 91 until stopped by retaining ring 94. Thrust bearing 72 is fitted over lower end 92 of swivel subassembly 70. Swivel cap 74, having opening 93 extending therethrough, is slipped over coupling threads 88 disposed on lower end 92 of swivel subassembly 70 and is operatively coupled to valve subassembly 62 thereby sandwiching retaining ring 94 between valve subassembly 62 and shoulder 95 of swivel cap 74. As obvious to those skilled in the art, swivel cap 74 can be threaded to valve subassembly 62 or it can be fastened using any other suitable means. By coupling swivel subassembly 70 to valve subassembly 62 in this manner, swivel subassembly 70 can rotate relative to valve subassembly 62 while valve subassembly 62 remains stationary.

Sandplug 54 is threaded onto pickup subassembly 52 before pickup subassembly 52 is threaded into box end 61 of valve subassembly 62. Ring 80 provides means for attaching a chain or a hook from a winch cable to apparatus 50 whereby apparatus 50 can be raised or lowered. O-ring 56 provides a seal between sand plug 54 and valve subassembly 62. Sleeve 60 and breakout band 58 further secure pickup subassembly 54 to valve subassembly 62. Port 65 extends through the sidewall of valve subassembly 62 and is positioned between ball valve 63 and box end 61. A hardened elbow, such as those made by Chicksan™ is attached to port 65 to direct the flow of sand through a hose (not shown) to a pit for collecting the sand.

Due to the abrasive effects of sand flowing through the apparatus and the sharp bend taken by the flow of sand takes to exit valve subassembly 62 through port 65, the use of this first embodiment is generally limited to cleaning sand from wells having formations pressures not greater than 2500 psi. ESD actuator 78 is mounted to valve subassembly 62 via ESD mounting tower 76 and operates the ball valve mechanism (not shown) of valve subassembly 62. The control line (not shown) connects ESD actuator 78 to a remotely located control switch (not shown) typically mounted near the platform of a well service rig (not shown).

Figure 5:
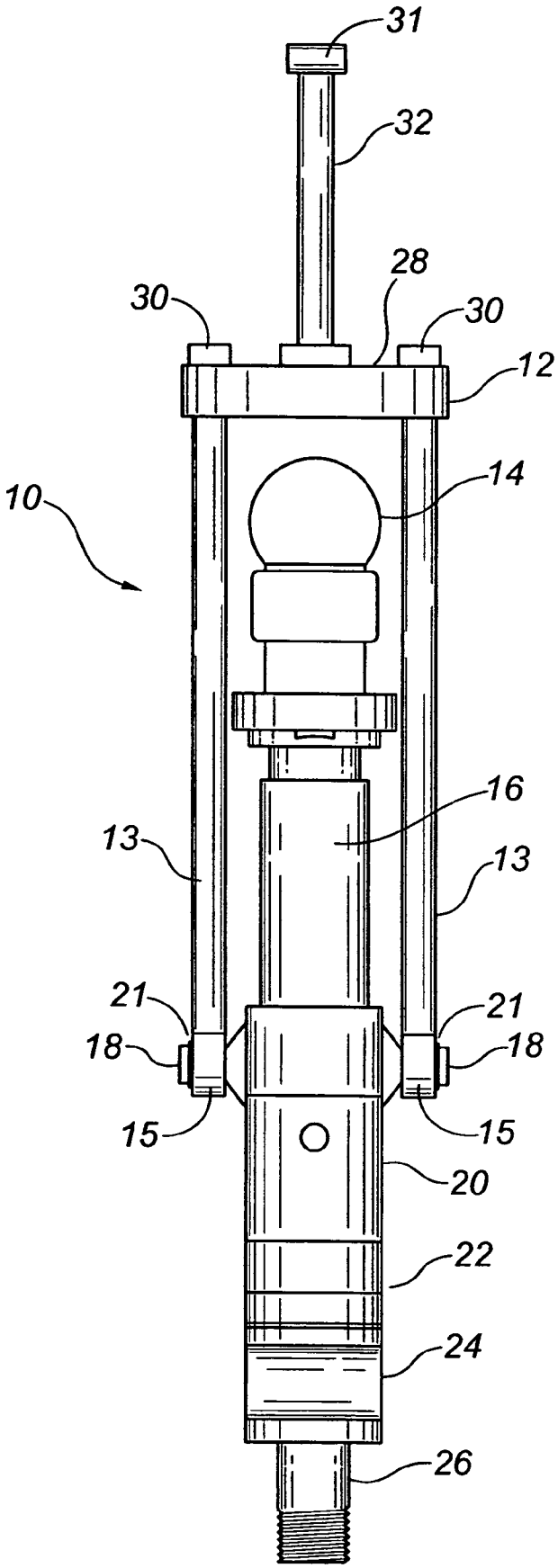
FIG. 5 is a front elevational view of a second embodiment of the apparatus of the present invention.
Figure 6:
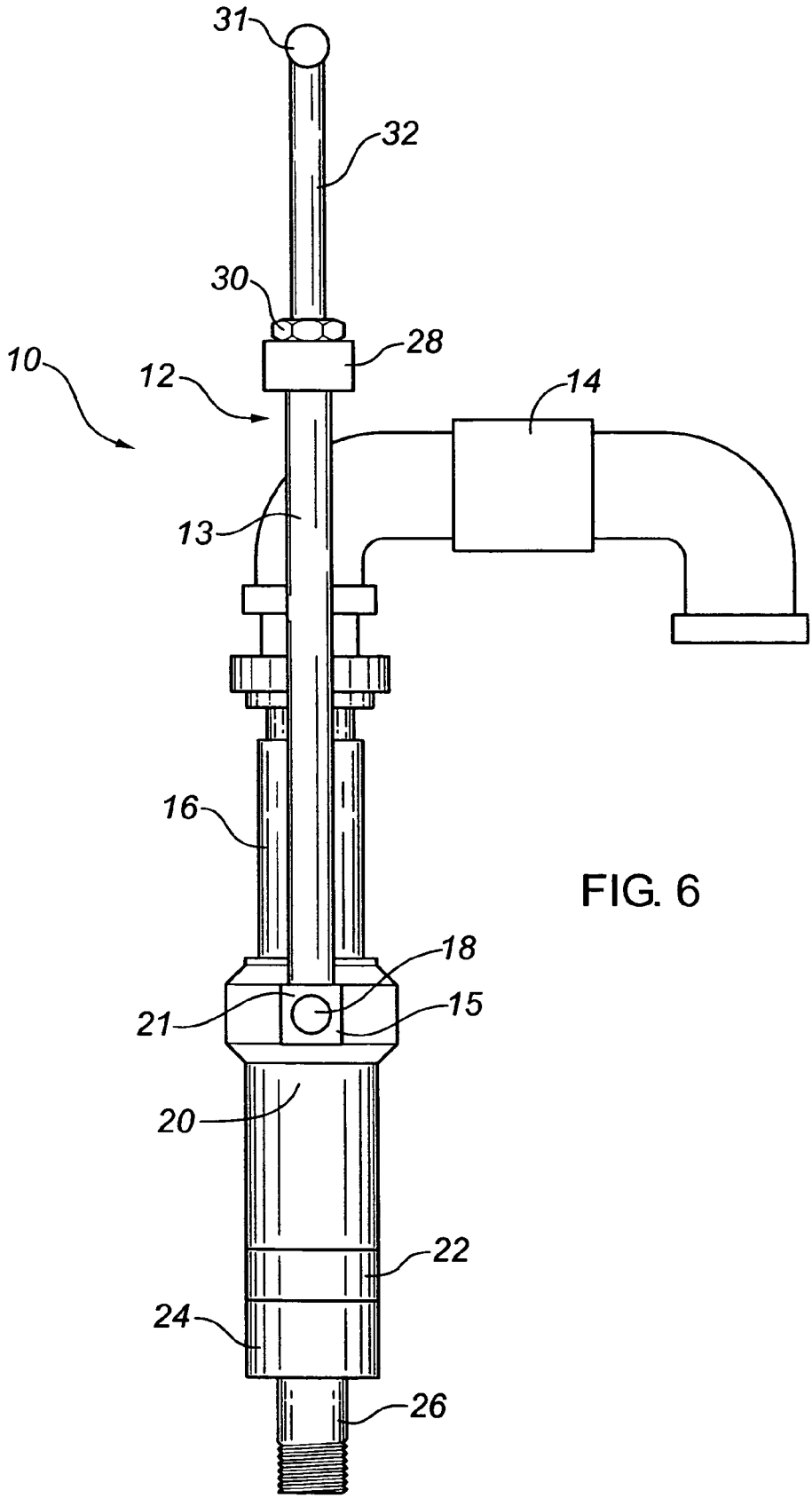
FIG. 6 is a side elevational view of the second embodiment of the apparatus of the present invention.
Figure 7:
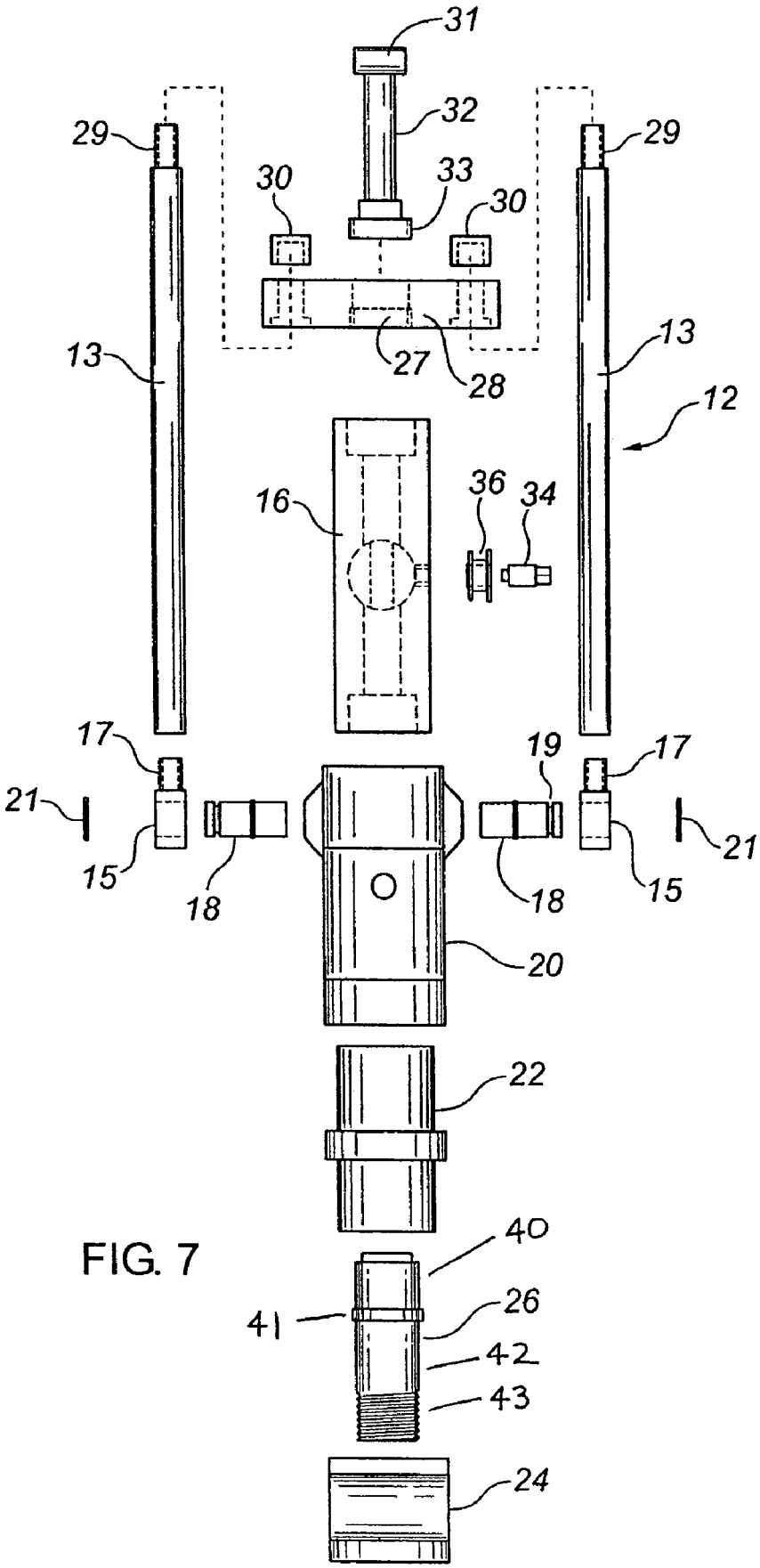
FIG. 7 is an exploded front view of the second embodiment of the apparatus of the present invention.

Referring to FIGS. 5, 6 and 7, a second embodiment of the apparatus of the present invention is illustrated. Apparatus 10 comprises valve subassembly 16, valve cradle 20, swivel crossover 22, swivel subassembly 26, swivel cap 24, lifting assembly 12, lifting lugs 18 and elbow 14. In this embodiment, valve subassembly 16 is the same type of subassembly as valve subassembly 62 with exception of valve subassembly 16 not having a port 65. Valve subassembly 16 sits in valve cradle 20 and is secured in place with setscrews. Swivel crossover 22 is threaded into valve cradle 20. Swivel subassembly 26 can comprise upper end 40, lower end 42 and retaining ring 41 disposed therebetween. Lower end 42 can further comprise threads 43. Upper end 40 of swivel subassembly fits within swivel crossover 22. Swivel cap 24 slips over swivel subassembly 26 and is threaded onto swivel crossover 22. This secures swivel subassembly 26 to swivel crossover 22 but still allows swivel subassembly 26 to rotate within swivel crossover 22. Coupled to the top of valve subassembly 16 is elbow 14. Elbow 14 is a hardened device, as made by Chicksan™ as an example, for bearing the brunt of the abrasive effects of sand flowing through apparatus 10 under pressure. As the placement of elbow 14 on top of valve subassembly 16 allows sand to flow straight through valve subassembly 16, this second embodiment is generally suitable for cleaning sand from underbalanced wells having formations pressure greater than 2500 psi, but not more than the pressure rating of valve subassembly 16, where the abrasive effects of sand flowing under such pressures would quickly wear out the first embodiment of the apparatus of the present invention.

ESD actuator 34 is mounted to valve subassembly 16 via ESD mounting tower 36 and operates the ball valve mechanism (not shown) of valve subassembly 16. The control line (not shown) connects ESD actuator 34 to a remotely located control switch (not shown) typically mounted near the platform of a well service rig (not shown).

To support apparatus 10, lifting assembly 12 is pivotally attached to valve cradle 20. Lifting assembly 12 includes fork head 22 having two legs 13 secured to it by locking caps 30. At the bottom of legs 13 are ends 15 having apertures for fitting over lugs 18. Lugs 18 are threaded into valve cradle 20. Ends 15 slide over lugs 18 and are secured by circlips 21 fitted into grooves 19 of lugs 18. Rod 32 is threaded into yoke 28 and is capable of being connected to an elevator of a well service rig.

Figure 8:
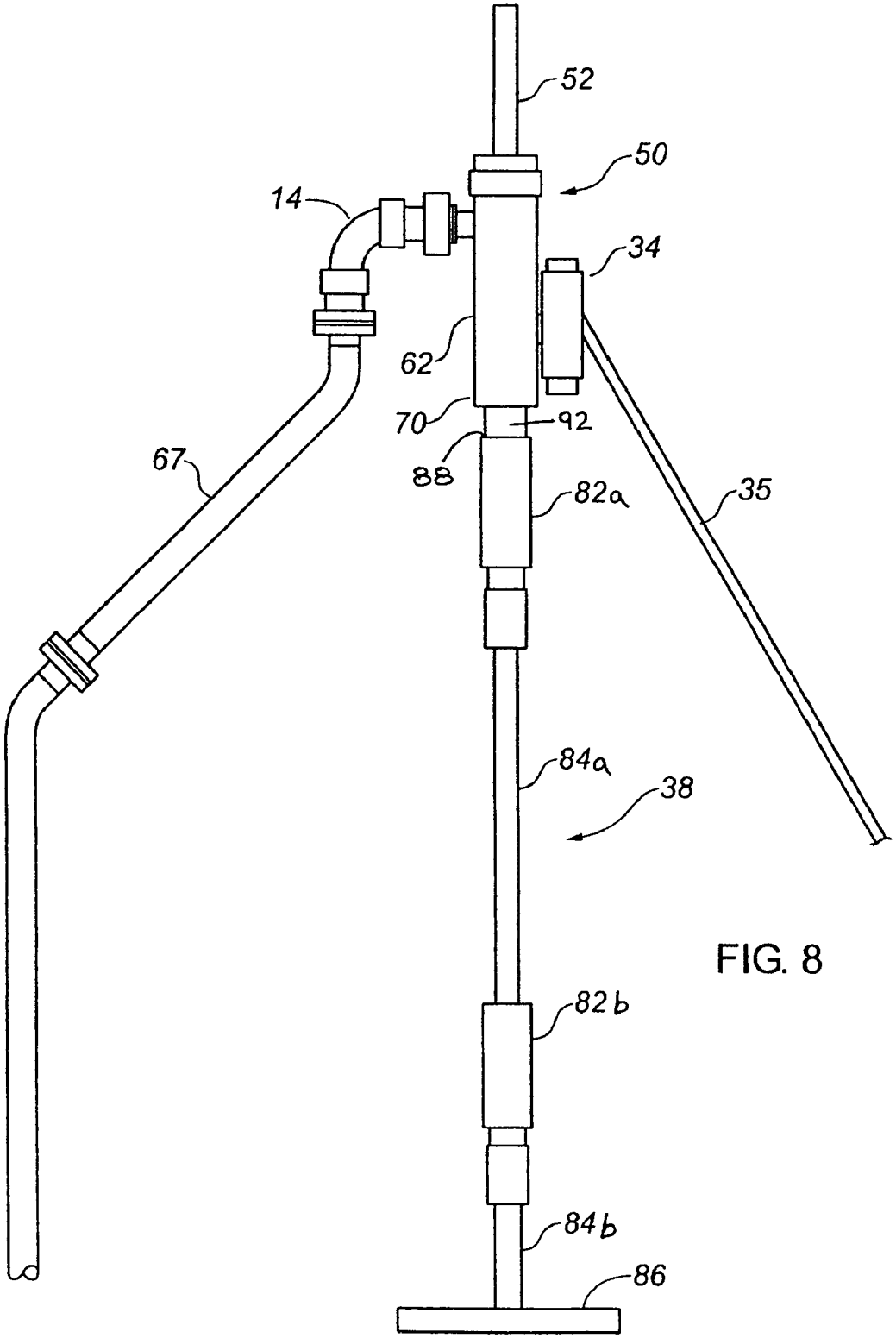
FIG. 8 is a front elevational view of the first embodiment of the apparatus of the present invention in operation.

In operation, as shown in FIG. 8, the first embodiment of the apparatus of the invention, apparatus 50 is supported by pickup subassembly 52 which, in turn, is attached to an elevator of a well service rig (not shown). Operatively coupled to the inlet of valve subassembly 62 via swivel subassembly 70 is valve 82*a* which is, in turn, coupled to tubing 84*a*. Valve 82*a* is coupled to coupling threads 88 disposed on lower end 92 of swivel subassembly 70. Additional valves 82*b* and tubing 84*b* may be included to form string 38 that is inserted to the well through wellhead 86. Attached to valve subassembly 62 is ESD actuator 34. Control line 35 couples ESD actuator 34 to a remotely located switch (not shown). Elbow 14 connects a port (e.g., 65 shown in FIG. 4) of valve subassembly 62 to hose 67. Hose 67 leads to an open pit (not shown) where sand is directed.

Valve 82 is closed when tubing 84 is inserted into the well through wellhead 86. Once valve 82 is positioned above wellhead 86, valve 82 is opened to allow gas from the well formation to rise through tubing 84 and to exit through the port of valve subassembly 62, carrying sand along with it. The gas/sand mixture flows through hose 67 to the pit where the sand collects and the gas is released to the atmosphere. Additional joints of tubing 84 and valves 82 can be added to string 38 to continue to process.

During the sand cleanout operation, line 35 is connected to ESD actuator 34. In lowering tubing 84 into the well, string 38 may be rotated to ease the descent of string 38 into the well. Swivel subassembly 70 allows string 38 to rotate while keeping valve subassembly 62 stationary. In the event of an emergency requiring the sand cleanout operation to be terminated, an operator simply activates the remote control switch to cause ESD actuator 34 to close the ball valve of valve subassembly 62. The advantage of the present invention is that when joints of tubing 84 are tripped into or out of string 38, line 35 does not have to be continuously disconnected and reconnected to ESD actuator 34 for each joint of tubing. This speeds up the sand cleanout operation and results in considerable time savings for the operator. It also maintains a degree of safety during these operations as ESD actuator 34 is kept operational even when joints of tubing 84 are tripped into or out of string 38.

Using the second embodiment of the apparatus of the present invention in operation is similar to that of the first embodiment. The only difference is that elbow 14 is attached to the top of valve subassembly 16. As discussed above, the first embodiment is generally used to clean out wells having formation pressures not greater than 2500 psi whereas the second embodiment is used with well with formations pressures greater than 2500 psi.

Although a few illustrative embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

We claim:

1. An apparatus for cleaning out sand from an underbalanced hydrocarbon producing well, comprising:

a) a valve subassembly having a valve body comprising:
   i) an upper end having coupling means,
   ii) a lower end having an opening adapted to receive a swivel subassembly,
   iii) a passageway disposed within said valve body providing communication between said upper and lower ends, and
   iv) a valve mechanism disposed in said passageway for opening and closing said passageway;

b) a swivel subassembly comprising a tubular member having upper and lower ends and a retaining ring disposed therebetween, said upper end disposed in said opening of said lower end of said valve body, said lower end comprising coupling means; and c) a swivel cap comprising an opening extending therethrough, said swivel cap disposed over said lower end of said swivel subassembly whereby said lower end and coupling means extend through said swivel cap opening, said swivel cap operatively coupled to said lower end of said valve body thereby sandwiching said retaing ring between said valve body and said swivel cap, whereby said swivel subassembly is secured to said valve body and can rotate relative to said valve body.

2. The apparatus as set forth in claim 1 further comprising lift support means operatively coupled to said valve subassembly for attaching with an elevator of a well service rig.

3. The apparatus as set forth in claim 2 further comprising an elbow having a first end operatively coupled to said upper end of the said valve body.

4. The apparatus as set forth in claim 3 further comprising a flow line operatively coupled to a second end of said elbow.

5. The apparatus as set forth in claim 2 wherein said lift support means comprises:

a) a valve cradle operatively coupling said valve body to said swivel subassembly; and b) a lifting subassembly operatively coupled to said valve cradle and adapted to attach to an elevator of a well service rig.

6. The apparatus as set forth in claim 5 wherein said valve cradle further comprises a swivel crossover and a swivel cap to operatively couple said valve body to said swivel subassembly.

7. The apparatus as set forth in claim 5 wherein said lifting subassembly comprises a fork assembly pivotally attached to said valve cradle, and an upper attachment means for coupling said fork assembly to said elevator.

8. The apparatus as set forth in claim 1 wherein said valve mechanism is adapted to be operated by a remotely controlled valve actuator.

9. The apparatus as set forth in claim 8 wherein said valve actuator is an emergency shut-in device operated by an air or a hydraulic control line.

10. The apparatus as set forth in claim 1 further comprising a port extending through a sidewall of said valve body for providing communication to said passageway, said port disposed between said upper end and said valve mechanism of said valve body.

11. The apparatus as set forth in claim 10 further comprising a pickup subassembly operatively coupled to said upper end of said valve body, said pickup subassembly adapted to operatively couple to an elevator of a well service rig.

12. The apparatus as set forth in claim 11 further comprising a sand plug disposed in said passageway of said valve body between said upper end and said port, said sand plug provided to prevent excessive abrasion wear to said valve body due to sand exiting said port.

13. The apparatus as set forth in claim 11 further comprising an elbow having a first end operatively coupled to said port of said valve body.

14. The apparatus as set forth in claim 13 further comprising a flow line operatively coupled to a second end of said elbow.

15. The apparatus as set forth in claim 11 further comprising a sleeve disposed about said valve body to secure said pickup subassembly to said valve body.

16. A method for cleaning out sand from an underbalanced hydrocarbon producing well, the method comprising the steps of:

a) attaching an apparatus comprising of:
   i) a valve subassembly having a valve body comprising:
      1. an upper end having coupling means,
      2. a lower end adapted to couple to a swivel subassembly,
      3. a passageway disposed within said valve body providing communication between said upper and lower ends, and
      4. a valve mechanism disposed in said passageway for opening and closing said passageway,
   ii) a swivel subassembly operatively coupled to said lower end of said valve body, and
   iii) lift support means operatively coupled to said valve subassembly for attaching with an elevator of a well service, the valve mechanism of said apparatus in an open position;

b) attaching a first joint of tubing to a lower end of a second valve subassembly;

c) attaching an upper end of said second valve subassembly to the swivel assembly of said apparatus, said second valve subassembly in a closed position;

d) lowering said first joint of tubing into said well; and e) opening said second valve subassembly whereby the pressure of a hydrocarbon formation in said well forces said sand up said tubing and exiting through said apparatus.

17. The method as set forth in claim 16 further comprising the step of directing said sand exiting said apparatus through a hose to a collection pit for said sand.

18. The method as set forth in claim 16 further comprising the steps of:

a) lowering said first joint of tubing into said well until said second valve subassembly is positioned just above a wellhead of said well;

b) closing said second valve subassembly;

c) detaching said apparatus from said second valve subassembly;

d) attaching a second joint of tubing to said second valve subassembly;

e) attaching a third valve subassembly to the upper end of said second joint of tubing;

f) attached said apparatus to the upper end of said third valve subassembly;

g) opening said second valve subassembly;

h) lowering said second joint of tubing into said well;

i) opening said third valve subassembly whereby the pressure of a hydrocarbon formation in said well forces said sand up said tubing and exiting through said apparatus.

* * * * *